US005388730A

United States Patent [19]

Abbott et al.

[11] Patent Number: 5,388,730

[45] Date of Patent: Feb. 14, 1995

[54] LOCKABLE ACTUATOR FOR A DISPENSING CANISTER

[75] Inventors: Joe L. Abbott, Cumberland; Michael S. Andrade, Central Falls, both of R.I.

[73] Assignee: Enviro Pac International L.l.c., Lincoln, R.I.

[21] Appl. No.: 150,611

[22] Filed: Nov. 10, 1993

[51] Int. Cl.[6] ..... B65D 83/20; B65D 83/22

[52] U.S. Cl. ..... 222/153; 222/402.11; 222/402.13

[58] Field of Search ..... 222/153, 182, 384, 402, 222/402.11, 402.13

[56] References Cited

U.S. PATENT DOCUMENTS

| | | | |
|---|---|---|---|
| 3,006,510 | 10/1961 | Sagarin | 222/402.11 X |
| 3,185,350 | 5/1965 | Abplanalp et al. | 222/182 |
| 3,249,260 | 5/1966 | Goldberg | 222/533 X |
| 3,325,054 | 6/1967 | Braun | 222/39 |
| 3,422,996 | 1/1969 | Libman | 222/384 X |
| 3,484,023 | 12/1969 | Meshberg | 222/402.11 |
| 3,531,026 | 9/1970 | Venus | 222/402.11 |
| 3,608,791 | 9/1971 | Jordan et al. | 222/402.11 |
| 3,721,423 | 3/1973 | Shay | 222/402.11 X |
| 3,848,778 | 11/1974 | Meshberg | 222/402.11 |
| 3,860,149 | 1/1975 | Hagianis | 222/153 |
| 3,933,283 | 1/1976 | Hoagland | 222/402.13 |
| 4,324,351 | 4/1982 | Meshberg | 222/402.11 |
| 4,454,966 | 6/1984 | Hicks | 222/153 |
| 4,572,410 | 2/1986 | Brunet | 222/402.11 |
| 4,589,574 | 5/1986 | Foster | 222/153 |
| 4,773,567 | 9/1988 | Stoody | 222/153 |
| 4,889,262 | 12/1989 | Toms | 222/153 |

*Primary Examiner*—Andres Kashnikow
*Assistant Examiner*—Kenneth Bomberg
*Attorney, Agent, or Firm*—Weingarten, Schurgin, Gagnebin & Hayes

[57] ABSTRACT

A lockable actuator mechanism for an aerosol or pump dispensing canister is disclosed. The lockable actuator comprises a collar fixedly mounted to a canister and an actuation plunger concentrically mounted in the collar. The collar includes a shoulder onto which the actuation plunger may be rotated into a locked, safety position to prevent depression of the plunger. Tabs located on the collar above the plunger prevent the plunger from being removed from the housing and cooperate with a detent on the shoulder to wedge the plunger over the shoulder and prevent the plunger from rotating back into the operative position. The tabs also eliminate the need for a friction fit of the actuation plunger on the valve stem. The actuation plunger has an internal annular shoulder against which the valve stem abuts in the depressed position. In the non-dispensing position, a clearance gap is provided between the valve stem and the annular shoulder to prevent accidental depression or tilting of the valve stem by jostling of the actuation plunger. A strong spring aids in biassing the valve stem against the annular shoulder to form a tight seal against leaks during actuation and closes the valve mechanism when the plunger is not depressed.

29 Claims, 5 Drawing Sheets

LOCKABLE ACTUATOR FOR A DISPENSING CANISTER

FIELD OF THE INVENTION

This invention relates to dispensing containers, and more particularly to a lockable actuator mechanism to prevent accidental operation of the container.

BACKGROUND OF THE INVENTION

Aerosol dispensing containers generally comprise a pressurized canister within which is stored a product to be dispensed as an aerosol. The canister is pressurized, for example, by a propellant which may be dissolved within the product. The product is released from the canister upon opening of a valve mechanism.

The valve mechanism generally comprises a valve stem having a passage therein through which product may flow. An orifice is provided in the wall of the valve stem to provide access to the passage. The valve stem is normally biassed to a position in which the orifice is blocked or sealed, so that product cannot enter the passage in the valve stem. A valve actuation assembly is fixedly mounted on the canister to overly the valve stem. When the actuation assembly is appropriately triggered, the valve actuation assembly depresses or tilts the valve stem against the biassing force to unblock the orifice and allow the pressurized product within the canister to enter the passage in the valve stem.

Typically, the actuator assembly includes a housing fixed to the canister and an actuator plunger within the housing. The plunger fits over the valve stem so that the passage in the valve stem communicates with a passage in the plunger. The plunger is frictionally fitted to the valve stem to retain the plunger thereon. The plunger passage terminates at a dispensing orifice or nozzle. Thus, when the plunger is depressed by a user, the valve stem is also depressed. As the valve stem is depressed, the orifice within the valve stem is moved away from the seal, and the pressure within the canister pushes product up through the orifice and the passage in the valve stem, through the actuator plunger passage, and out the dispensing orifice in the actuator plunger. After dispensing the desired amount of product, the plunger is released. A spring within the valve mechanism provides the restoring or biassing force to return the valve stem to the closed position in which the orifice is sealed. FIGS. 1 through 4 illustrate a typical prior art actuation mechanism of this type.

To prevent accidental discharge of product from the canister, as illustrated in FIGS. 3 and 4, the actuation plunger may be rotatable about the longitudinal axis of the container to a safety position in which a tab or handle portion on the plunger is moved over a shoulder located on the actuator housing, thereby preventing the plunger from being depressed. Rotation of the actuation plunger also turns the dispensing orifice to a position against the actuator housing to further prevent discharge of the contents of the canister.

As set forth above, the actuation plunger is frictionally fitted over the valve stem to prevent the plunger from falling off. However, several disadvantages arise from use of a friction fit of the plunger to the valve stem. The plunger is typically manufactured from a thermoplastic material, such as polyethylene or polypropylene, by an injection molding process. Thermoplastics are subject to expansion and contraction as the temperature changes, and it is difficult to control the final dimensions of an injection molded piece as the plastic cools. As a result, it is difficult to achieve a tolerance of, for example, ±0,002 inch, which is the desired tolerance to ensure a proper friction fit between the plunger and the valve stem.

Accordingly, the friction fit is not always reliable. The plunger may fall off in spite of the friction fit or in response to other forces. For example, canisters of this nature are typically used to contain pepper gas, a self-defense product. Such canisters are carried in purses or pockets where other items frequently bang the plunger to rotate it out of the safety position and wedge or pull the plunger off. The exposed valve stem is then subject to depression and accidental firing by further jostling or banging. Additionally, the orifice of the valve stem can frequently be unblocked merely by tilting the valve stem. In this case, tilting or other movements of the plunger, even if the plunger is in the safety position, may concomitantly cause tilting of the valve stem and flow of product into the valve stem passage. The product in the passage can then leak out, either through the nozzle and down the inside of the housing, or around the friction fit between the plunger and valve stem, since the friction fit may not provide an adequate seal. In any case, the product is wasted and creates an undesirable mess inside a purse or pocket.

A further disadvantage of the friction fit arises during manufacture of the container. The valve actuation assembly is generally attached to the canister after the valve mechanism has been attached and the canister charged with pressurized product. Thus, depression of the valve stem would cause release of product. However, in frictionally fitting the plunger of the valve actuation assembly over the valve stem, the valve stem is subject to depression and, in practice, frequently is depressed, resulting in discharge of product. The discharged product again creates a mess and over a period of time the wasted product can give rise to significant economic losses.

Several variations of the actuator described above are found in the prior art. U.S. Pat. No. 3,848,778 to Meshberg discloses an actuation plunger that is rotatable between a dispensing position and a nondispensing or safety position in which the discharge orifice is blocked by a wall. The actuation plunger is locked in the nondispensing position by a tongue or key on a flexible tab of the actuator housing which is received in a corresponding slot or groove in the actuation plunger. However, to unlock the actuation plunger, the flexible tab must be moved radially outwardly by the fingernail of one hand while the plunger is rotated by the other hand.

U.S. Pat. No. 3,325,054 to Braun discloses an aerosol valve employing a complex arrangement in which stop lugs are formed on the valve button to prevent it from being depressed until the valve button is rotated to align the stop lugs with correspondingly shaped cutouts in a valve button lock. Downwardly depending fingers on the button retain the button on the lock.

U.S. Pat. No. 3,608,791 to Jordan et al. discloses an actuator assembly that includes a rotatable actuator button mounted within a cap member. A vertically oriented ridge on the button engages one of a pair of corresponding notches to hold the button in either a dispensing position or a nondispensing position in which the spout engages a stepped surface to prevent depression. The button is retained on the valve stem by friction. U.S. Pat. No. 3,249,260 to Goldberg discloses an actuator assembly that includes a rotatable lid with a spout thereon concentrically mounted in a support member. The spout possesses a bead which engages a groove on an upper step of the support member when the lid is rotated to prevent actuation. U.S. Pat. No. 3,185,350 to Abplanalp et al. also shows a rotatable actuator which can be raised and rotated over a camming member to prevent depression thereof and discharge of product. The actuator is tightly fitted to the valve stem to be movable therewith.

These variations of the actuator mechanism do not address all of the shortcomings identified above, however. A need still exists for an actuator mechanism that is simple to manufacture by injection molding, that can be installed on the valve assembly without causing accidental firing and discharge of product, that can be retained in a safety position on the canister, yet can be easily and quickly returned to the operative position, that prevents leakage, and that is not subject to accidental firing even in the safety position.

SUMMARY OF THE INVENTION

The present invention provides a lockable actuator for a pressurized aerosol or pump canister that overcomes the shortcomings of prior art actuators. The lockable actuator comprises a housing or collar which is fixedly attached to the canister and an actuation plunger concentrically mounted within the collar. The actuation plunger is slip fitted over the valve stem, rather than frictionally fitted as in prior art actuators. In the non-dispensing position, a clearance gap is provided between the valve stem and an annular shoulder inside the plunger to prevent accidental depression or tilting of the valve stem by jostling of the actuation plunger. A strong spring is used to bias the valve stem against the annular shoulder to form a tight seal against leaks during actuation. The spring also requires a greater force to depress the actuation plunger into the dispensing position, and therefore provides further assurance against accidental discharge of the product.

The collar includes a shoulder over which a tab of the actuation plunger may be rotated into a safety position. An upraised detent is formed on the shoulder. At least one tab is integrally formed with the collar to overly the plunger. Once rotated to the safety position over the collar shoulder, the actuation plunger becomes wedged between the overlying tab or tabs and the upraised detent on the collar shoulder. In this manner, the plunger is prevented from rotation back into an operative position. Also, the tabs prevent the plunger from falling off and exposing the valve stem.

Additionally, because the tabs prevent the actuation plunger from being removed from the housing, retention of the plunger to the valve stem by a friction fit is no longer necessary. Elimination of the friction fit minimizes the likelihood that jostling of the plunger, even in the safety position, will cause accidental opening of the valve mechanism. Further, because the plunger does not need to be frictionally fitted over the valve stem during installation, accidental depression of the valve stem and firing of the valve mechanism is also prevented.

DESCRIPTION OF THE DRAWINGS

The invention will be more fully understood from the following detailed description taken in conjunction with the accompanying drawings in which.

DETAILED DESCRIPTION OF THE INVENTION

Figure 5:
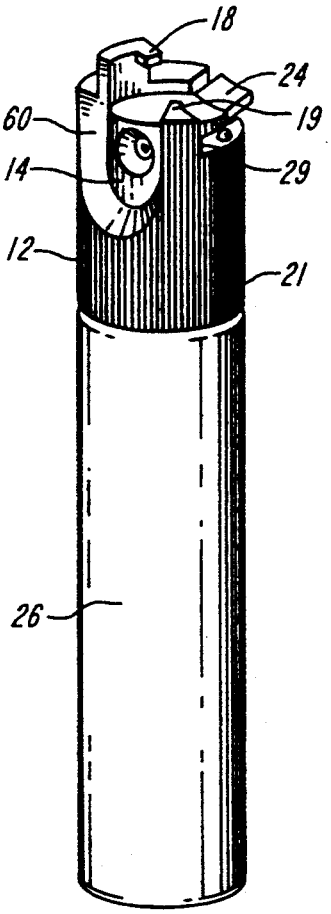
FIG. 5 is a perspective view of an actuator mechanism of the present invention mounted on a pressurized canister.

As illustrated in FIG. 5, an aerosol dispensing container according to the present invention comprises a pressurized canister 26 and an actuator mechanism 10. The pressurized canister 26 contains a product to be dispensed as an aerosol, such as repellents, cleaners, fresheners, oils, foodstuffs, or any other compound that may be dispensed as an aerosol. Typically, a pressurized gas propellant, such as carbon dioxide or another suitable gas, is dissolved in the product, although any suitable manner of pressurizing the canister may be used. The actuator mechanism 10 comprises an actuation plunger 14 contained within or mounted on a collar 12 attached to the pressurized canister 26. Depression of the actuation plunger operates a valve assembly, shown more fully in FIGS. 8 and 9, to allow product to be dispensed through an orifice or nozzle in the plunger.

Figure 8:
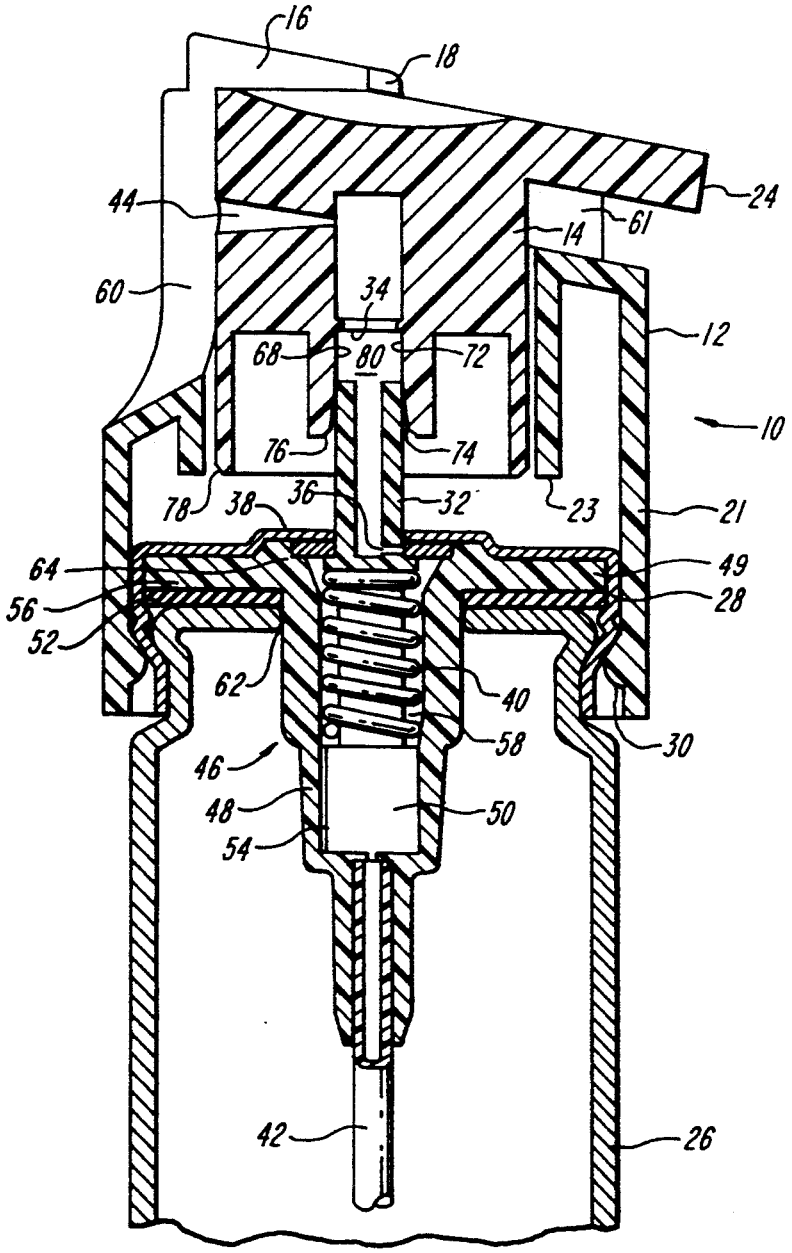
FIG. 8 is a cross-sectional view along line 8—8 of FIG. 6 of the actuator mechanism of FIG. 5 in the unlocked position.
Figure 9:
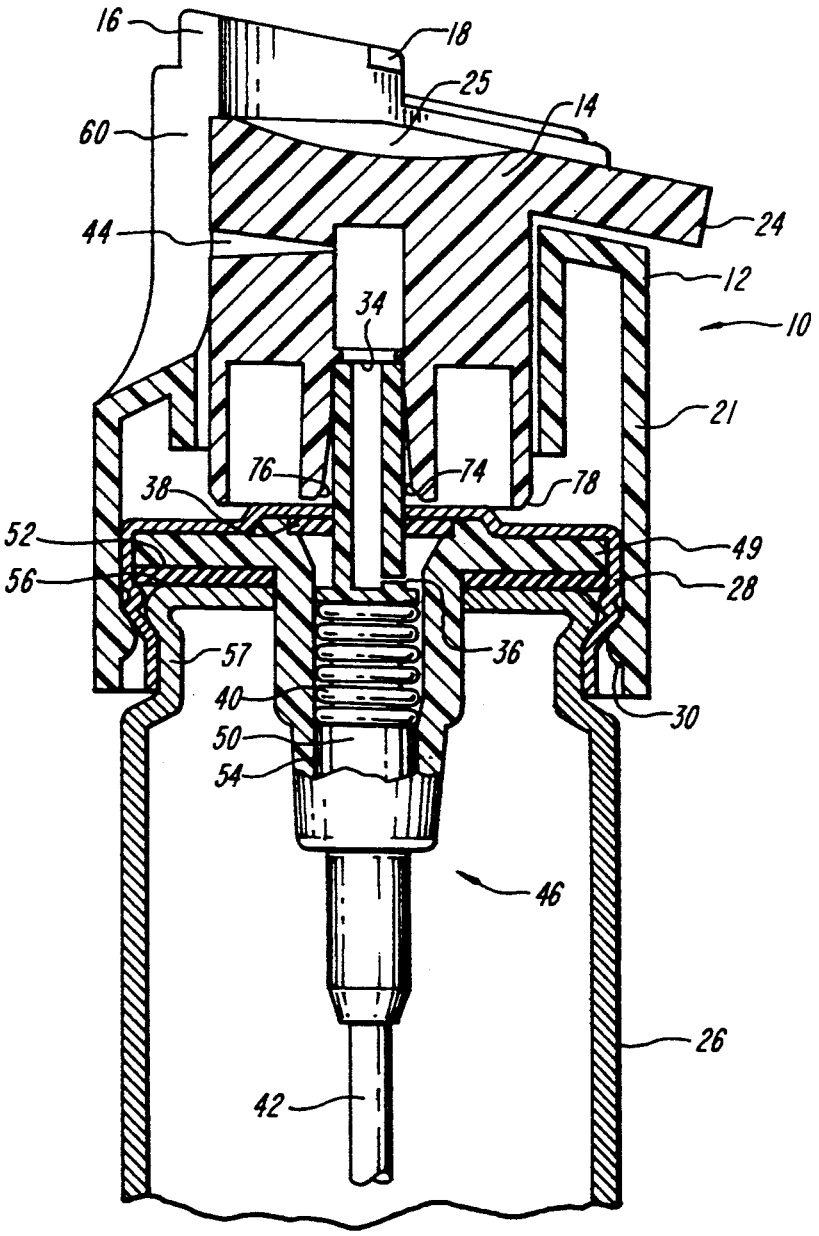
FIG. 9 is a cross-sectional view of the actuator mechanism of FIG. 6 in a depressed dispensing position.

Referring to FIGS. 8 and 9, the canister 26 of the present invention is generally cylindrical and is typically made from a metal such as aluminum coated with an inner protective coating to prevent the product from reacting with the metal. The canister has a generally flat top surface 56 with an opening 62 formed therein. A valve assembly 46 is located within the pressurized canister 26 for controlling the dispensing of the product. The valve assembly 46 includes a valve control element 48 having an outwardly directed annular flange 49 which rests on the top surface 56 of the pressurized canister 26. An elastomeric member 52 is placed between the top surface 56 of the canister 26 and the annular flange to form a seal. A metal cap 28 is configured to fit over the top of the valve control element 48 and the canister 26 and is crimped to the neck 57 of the canister 26 to close the pressurized canister 26 and fixedly attach the valve control element 48 thereto.

A compression spring 40 and a spring support 50 are provided within a chamber 58 in the valve control element 48. A dip tube 42 is attached to the valve control element 48 and extends to the bottom of the pressurized canister 26 to transfer product to the valve control element 48. A small passage 54 formed in the spring support 50 allows product to flow from the dip tube 42 past the spring support 50 into the chamber 58. A valve stem 32 extends upwardly through an opening in the cap 28. An orifice 36 for dispensing product is provided in the valve stem 32. A valve seal 38, such as an elastomeric 0-ring or washer, is seated in an inwardly facing annular shoulder 64 on the valve control element 48 and an outwardly facing annular shoulder 66 on the valve stem 32. The seal 38 is clamped in position by the cap 28. The spring 40 rests on the spring support 50 and biases the valve stem 32 upwardly in a nondispensing position such that the orifice 36 is at or above the level of the seal 38 and is thereby blocked from communication with the chamber 58 to prevent product from escaping from the chamber 58.

As the valve stem 32 is depressed downwardly into the dispensing position, as illustrated in FIG. 9, the spring 40 compresses and allows the orifice 36 to move away from the valve seal 38. The pressure within the pressurized canister 26 pushes the product up the dip tube 42, through the passage 54 and the valve control element 48, through the orifice 36, and up the valve stem 32.

The actuator mechanism 10 comprising the collar 12 and plunger 14 for depressing the valve stem is mounted onto the pressurized canister 26 over the cap 28. An inwardly extending mounting bead 30 is formed around the inner bottom edge of the collar to snap onto the crimped edge of the cap 28 to retain the collar on the canister 26, although any other suitable manner of attaching the collar to the canister may be used.

The valve stem 32 of the valve assembly 46 projects upwardly into the plunger 14. When the plunger is depressed to fire the valve mechanism, the valve stem abuts against an annular shoulder 34 integrally formed within the actuation plunger 14. The abutting relationship between the valve stem 32 and the annular shoulder 34 forms a seal to prevent leakage at this joint as product moves through the valve stem 32 and the actuator mechanism 10. The valve stem and the plunger should be formed from materials of different hardnesses to provide a slight yielding of the softer material when the valve stem is biassed closed to ensure a good seal. Also, the compression spring 40 is chosen to be sufficiently strong to keep the valve stem 32 firmly seated against the shoulder 34 in the dispensing position to provide a seal to prevent product from leaking around the outside of the valve stem. Additionally, a relatively strong spring provides a relatively fast shut-off of the valve when the plunger is released to stop product moving through the orifice 36.

As further illustrated in FIGS. 8 and 9, the valve stem 32 is retained within a passage 68 in the plunger 14 below the annular shoulder 34. The upper portion 72 of the passage 68 has a cylindrical configuration and is sized to provide a slip fit over the valve stem 32. The lower portion 74 of the passage 68 is tapered to provide a conical configuration. The conical configuration aids in guiding the valve stem within the passage 68 during firing. Thus, the valve stem 32 is not attached to the collar 12 by a friction fit between the valve stem 32 and the passage 68, as in prior art actuators. Elimination of the friction fit between the actuation plunger 14 and the valve stem 32 decreases loss of material accidentally discharged from the pressurized canister 26 during manufacture, as described more fully below.

A chamfer 76 is formed along the inside lower edge of the plunger 14. During injection molding, excess plastic may leak into the opening of the passage 68. If pieces of this excess plastic are scraped off as the valve stem travels within the passage 68, the pieces could plug up the nozzle or hinder the valve stem's travel within the passage, interfering with the operation of the valve. The chamfer 76 minimizes the possibility that excess plastic will be scraped off. The chamfer also reduces binding between the valve stem 32 and the passage 68.

Similarly, a chamfer 78 is formed along the outer lower edge of the plunger 14. This chamfer eliminates sharp edges of the plunger which could dig into the wall 23 of the collar 12, interfering with depression of the plunger.

In the non-dispensing position, either locked or unlocked, a clearance gap 80 remains between the top of the valve stem 32 and the shoulder 34, as shown in FIG. 8. The plunger must be lowered a short distance before the valve stem is depressed. The clearance gap prevents inadvertent depression or tilting of the valve stem by banging or jostling of the actuation plunger 14, thereby decreasing the possibility of product released while in the non-dispensing position.

Figure 10:
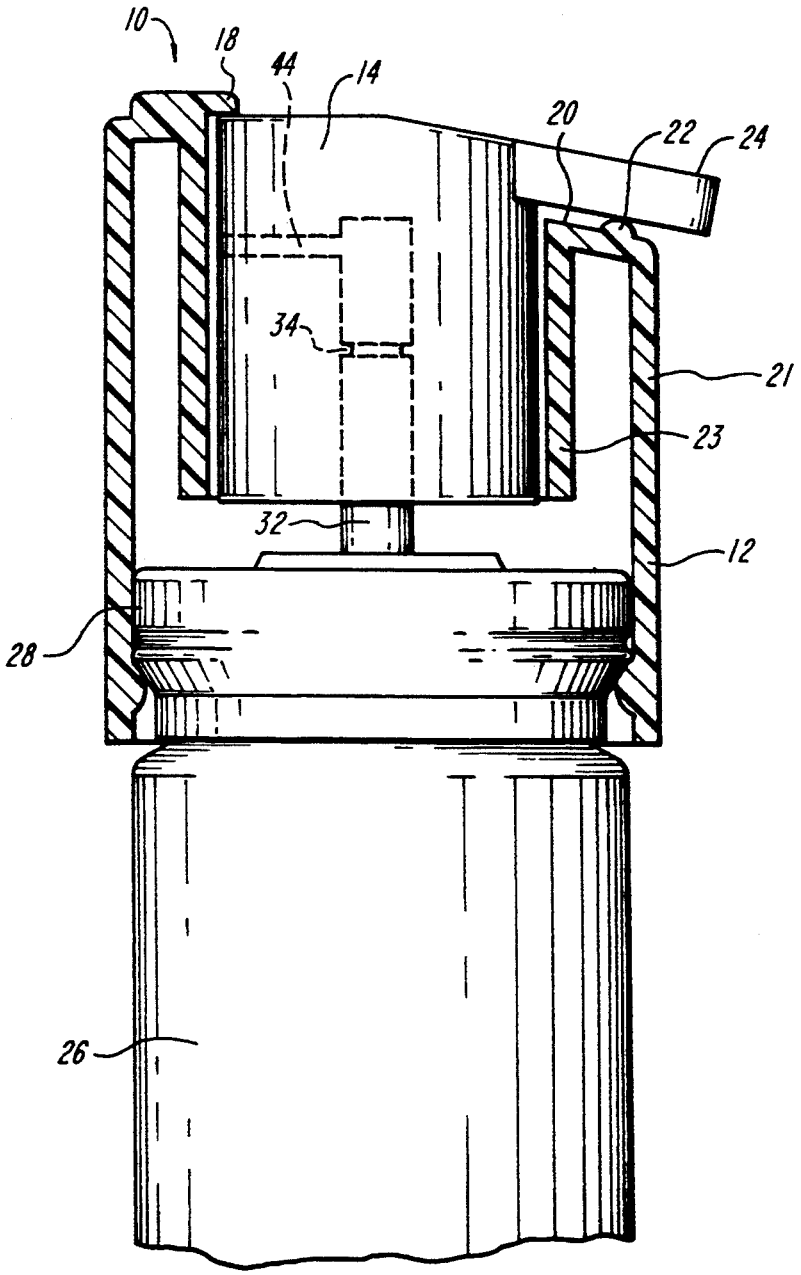
FIG. 10 is a cross-sectional view along line 10—10 of FIG. 7 of the actuator mechanism of FIG. 7 in the locked position.

The actuator plunger 14 is mounted concentrically within the collar 12 for reciprocating motion along the longitudinal axis of the collar and canister. The plunger includes a dispensing orifice 44 on one side and a finger tab 24 formed on top of the plunger facing the opposite side from the dispensing orifice 44. As shown in FIG. 10, the collar may be formed using a double walled construction having an outer wall 21 and an inner wall 23, the inner wall 23 forming a channel for the plunger 14, although a single walled configuration may be used if desired. An opening 60 is formed in the collar 12 to expose the dispensing orifice 44 in the plunger. A further opening 61 is formed in the collar 12 generally opposite to the opening 60 to permit depression of the finger tab 24. The finger tab 24 aids in placement of a finger for depressing the plunger and in aiming the dispensing orifice 44. A shallow depression 25 in the top of the plunger may be provided to prevent slippage of the finger.

Figure 1:
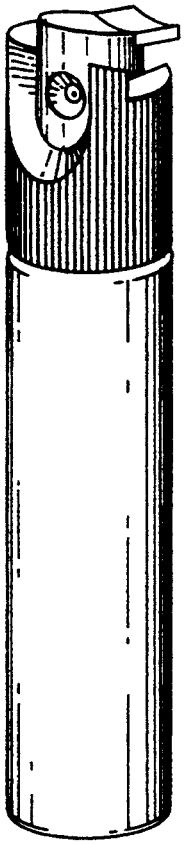
FIG. 1 (PRIOR ART)
FIG. 1 is a perspective view of a prior art actuator mechanism of a pressurized canister.
Figure 2:
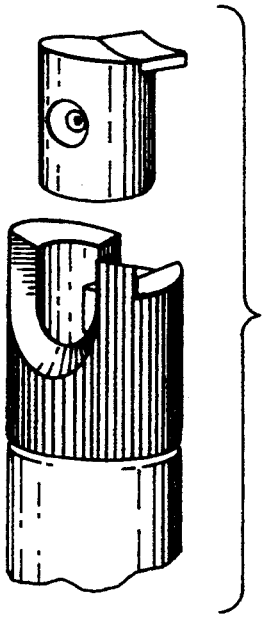
FIG. 2 (PRIOR ART)
FIG. 2 is a partial exploded view of the prior art actuator mechanism of FIG. 1.
Figure 3:
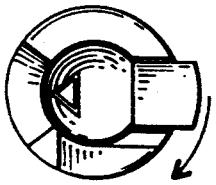
FIG. 3 (PRIOR ART)
FIGS. 3 and 4 are top plan views of the prior art actuator mechanism of FIG. 1.
Figure 4:
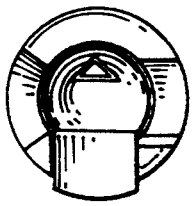
FIG. 4 (PRIOR ART)
Figure 6:
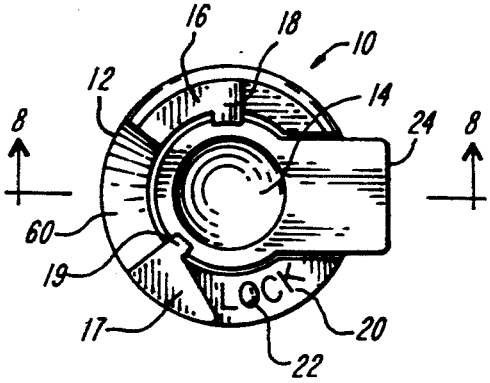
FIG. 6 is a top plan view of the actuator mechanism of FIG. 5 in an unlocked or operative position.
Figure 7:
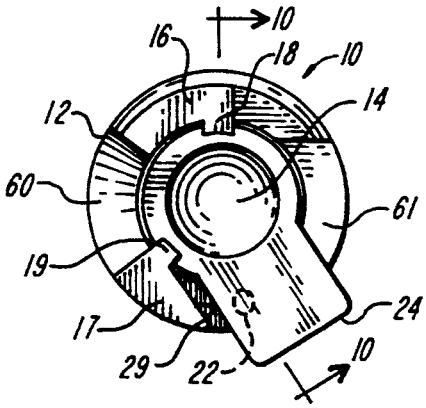
FIG. 7 is a top plan view of the actuator mechanism of FIG. 5 in the locked or safety position.

As shown more fully in FIGS. 5 through 7, the collar 12 includes a pair of locking tabs 18, 19 integrally formed at the top of wall projections 16, 17. The locking tabs 18, 19 extend inwardly over the opening into which the actuation plunger 14 is mounted to prevent removal of the actuation plunger 14 from the collar 12. As described more fully below, the tabs also eliminate the need for a friction-fit when the actuation plunger 14 is installed during manufacture.

The collar 12 also includes a shoulder 20 formed below the level of the locking tabs 18. In the operative, unlocked, position, shown in FIGS. 5, 6, 8, and 9, the finger tab 24 of the actuation plunger 14 is capable of being depressed below the level of the shoulder 20. An upraised detent 22 is formed on the shoulder 20. In the embodiment illustrated, the detent comprises the letter "O" in the word "LOCK" which is inscribed into or otherwise formed on the surface of the shoulder 20. As shown in FIGS. 7 and 10, the actuation plunger 14 is also rotatable about the longitudinal axis of the collar 12 into a safety position in which the finger tab 24 of the actuation plunger 14 is moved onto the shoulder 20 and over the detent 22. Simultaneously, the dispensing orifice 44 is rotated in front of the inner wall 23 to block discharge of product. Once rotated, the shoulder 20 prevents the actuation plunger 14 from being depressed by blocking downward motion. Detent 22 and locking tabs 18, 19 cooperate to wedge the actuation plunger 14 therebetween over the shoulder surface 20 to lock the actuation plunger 14 into the locked, safety position. Although two tabs 18, 19 are shown, any number of tabs may be provided. If only one tab is used, it should be located generally opposite the detent 22 on the shoulder 20; however, at least two tabs are preferable.

The vertical surface 29 of the wall projection 17 acts as a stop to prevent further rotation of the plunger. In the illustrative embodiment, the actuation plunger 14 is rotatable by approximately 50°, although other rotation angles are possible.

The actuation plunger 14 can be returned back into the unlocked, operative position by rotation in the opposite direction. However, a certain minimum force is required to unwedge the plunger 14. The locking force applied by the detent 22 and locking tabs 18, 19 is generally sufficient to prevent accidental rotation by normal jostling or banging against other objects in a purse.

Preferably, the collar 12 and the actuation plunger 14 are made of a thermoplastic material such as a high-density polyethylene or polypropylene plastic. Other materials may be used if desired. The actuation plunger may include a phosphorescent pigment to allow it to glow in the dark, thus allowing for easy identification in a purse. Alternatively, a fluorescent dye or bright paint may be used. Preferably, the collar and plunger are each formed by injection molding. The valve stem is typically made from a hard material, such as nylon or acetone copolymer.

The canister with the actuator mechanism of the present invention is particularly suitable for containing products to be carried in a purse or pocket where leakage prevention is important. For example, the canister is ideally suited for containing pepper gas, an organic, non-toxic self-defense product that can be sprayed at a dog or an assailant to deter them.

In manufacturing the pepper gas dispenser, a suitably sized empty canister 26 is provided. Typically, such canisters have either a 20 mm or a 1 inch outer diameter, although any other size may be used if desired. A predetermined amount of sodium bicarbonate and water are placed into the canister. The valve assembly 46 and seal 52 are seated onto the open top of the canister, with the dip tube 42 extending to the bottom of the canister and the valve stem 32 protruding above. The cap 28 is placed over the valve assembly 46, with the valve stem 32 protruding above, and crimped onto the neck 57 of the canister to hold the valve assembly in place with the spring 40 forcing the valve stem into the nondispensing position.

After the canister 26 has been sealed, a charge of pepper concentrate solubilized with isopropyl alcohol and citric acid is then forced into the canister through the valve stem 32 by depressing the valve stem. Inside the canister, the reaction of citric acid and sodium bicarbonate produces solubilized carbon dioxide, which is converted to a gas to propel the pepper gas out of the canister when the valve stem is subsequently depressed in the dispensing position.

The actuator mechanism 10 is preassembled from the collar 12 and the actuation plunger 14 by inserting the bottom of the plunger 14 into the top of the collar 12 and pressing it down over the locking tabs 18, 19 on the walls. The tabs are slightly sloped at the top to prevent the material from shearing as the plunger 14 is slid over them. The tabs deflect as the plunger is installed and return into place when installation of the plunger is complete. The squared off bottoms of the tabs prevent the plunger from being lifted back out of the collar.

The preassembled actuator assembly 10 is then installed onto the pressurized canister 26 by snapping the mounting bead 30 of the collar 12 over the canister cap 28. The valve stem 32 is fitted within the passage 68 of the plunger 14. In prior art canisters which rely on a friction fit between the valve stem and the plunger, the plunger must be forced down over the valve stem. This action may depress the valve stem, allowing product to flow through the orifice. The present invention overcomes this problem.

Next, the assembled aerosol dispensing container is inspected for leaks by immersion in a water bath at approximately 120° F. Then, the aerosol dispensing containers are dried and packed for shipment.

Figure 11:
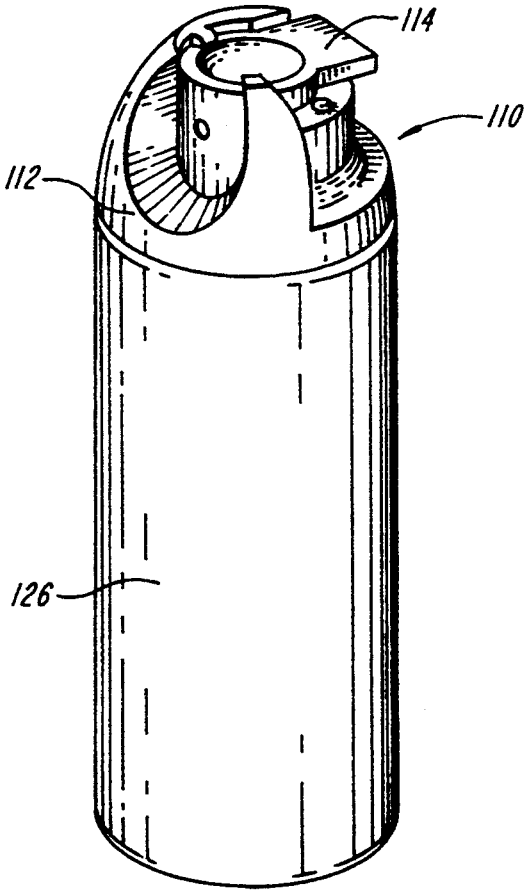
FIG. 11 is a perspective view of an alternative embodiment of the actuator mechanism of the present invention mounted on a pressurized canister.

Although collar 12 is illustrated to possess generally parallel sides, alternative embodiments such as that of actuator mechanism 110 illustrated in FIG. 11 implementing a rounded or curved collar 112 may be used. This embodiment is useful to fit the collar over a larger diameter canister 126, while retaining the same size plunger 114 and valve assembly. Similarly, variations in the valve assembly may be provided. Although the actuator mechanism of the present invention has been described in relation to aerosol canisters, it can also be used for pump canisters.

Although the invention has been shown and described with respect to an illustrative embodiment thereof, it should be appreciated that the foregoing and various other changes, omissions and additions in the form and detail thereof may be made without departing from the spirit and scope of the invention as delineated in the claims.

I claim:

1. A lockable dispenser comprising:

a pressurizable canister having a valve assembly; and an actuation mechanism attached to said canister, said actuation mechanism comprising a collar and an actuation plunger mounted within said collar in a contacting relation with said valve assembly and rotatable between a first operative position and a second inoperative position, said actuation plunger having an outwardly extending plunger tab thereon and said actuation plunger being slip fitted over a valve stem of said valve assembly in said first operative position and said second inoperative position, said collar further comprising:

a shoulder located beneath said plunger tab to prevent depression of said plunger when said plunger is in the second inoperative position, and at least one inwardly directed locking tab having a lower surface formed at a height above said shoulder to extend over said actuation plunger to hold said plunger within said collar, said lower surface of said locking tab and said shoulder being cooperatively located to wedge said plunger between said locking tab and said shoulder.

2. The lockable dispenser of claim 1, further comprising a detent protruding from said shoulder.

3. The lockable dispenser of claim 1, wherein said canister is pressurized by a gas dissolved in a product.

4. The lockable dispenser of claim 1, wherein said valve assembly comprises said valve stem protruding from said pressurizable canister.

5. The lockable dispenser of claim 4, wherein said actuation plunger further comprises a passage for receiving said valve stem, a portion of said passage having a tapered configuration to guide said valve stem.

6. The lockable dispenser of claim 5, wherein said passage has a chamfered lower edge adjacent said valve stem.

7. The lockable dispenser of claim 5, further comprising a biassing element disposed to bias said valve stem into a closed position.

8. The lockable dispenser of claim 7, wherein said biassing element comprises a compression spring.

9. The lockable dispenser of claim 3, wherein said gas is carbon dioxide.

10. The lockable dispenser of claim 4, wherein said actuation plunger further comprises an annular shoulder configured to abut a top of said valve stem when said actuation plunger is in a depressed position.

11. The lockable dispenser of claim 10, wherein said annular shoulder of said actuation plunger is spaced a predetermined distance from said top of said valve stem when said actuation plunger is in a non-depressed position.

12. The lockable dispenser of claim 1, further comprising at least two inwardly directed locking tabs formed at a height above said shoulder to extend over said actuation plunger.

13. The lockable dispenser of claim 1, wherein said actuation plunger includes a chamfer along a lower edge adjacent said collar.

14. A lockable dispenser comprising:

a pressurizable canister;

a valve assembly attached to said canister having a passage therein to provide an outlet for flow of product from said canister; and an actuation mechanism mounted onto said pressurized canister for operation of said valve assembly, said actuation mechanism comprising a collar mounted to a top of said canister, and an actuation plunger mounted within said collar in an abutting relation with said valve assembly, said actuation plunger having a dispensing channel formed therein for communication with said passage in said valve assembly said actuation plunger being slip fitted over a valve stem of said valve assembly in a first operative position and a second inoperative position, said collar further comprising:

an upstanding wall having an opening therein to expose said dispensing channel in said actuation plunger when said plunger is in said first position, a shoulder formed in said wall and positioned below the topmost height of said wall to prevent depression of said plunger when said plunger is in said second position rotated from said first position, a locking detent protruding from said shoulder, and at least one inwardly directed locking tab extending from the topmost height of said wall and rotatably spaced from said shoulder and formed at a height above said shoulder to extend over an upwardly facing surface of said actuation plunger to hold said plunger within said collar and wedge said plunger between said locking tab and said locking detent of said shoulder.

15. The lockable dispenser of claim 14, wherein said valve assembly comprises said valve stem protruding from said pressurizable canister.

16. The lockable dispenser of claim 15, wherein said actuation plunger further comprises a passage for receiving said valve stem, a portion of said passage having a tapered configuration to guide said valve stem.

17. The lockable dispenser of claim 16, wherein said passage has a chamfered lower edge adjacent said valve stem.

18. The lockable dispenser of claim 15, further comprising a biassing element disposed to bias said valve stem into a closed position.

19. The lockable dispenser of claim 18, wherein said biassing element comprises a compression spring.

20. The lockable dispenser of claim 15, wherein said actuation plunger further comprises an annular shoulder configured to abut a top of said valve stem when said actuation plunger is in a depressed position.

21. The lockable dispenser of claim 20, wherein said annular shoulder of said actuation plunger is spaced a predetermined distance from said top of said valve stem when said actuation plunger is in a non-depressed position.

22. The lockable dispenser of claim 14, further comprising at least two inwardly directed locking tabs formed at a height above said shoulder to extend over said actuation plunger.

23. The lockable dispenser of claim 14, wherein said actuation plunger comprises a chamfer along a lower edge adjacent said collar.

24. A lockable dispenser comprising:

a pressurizable canister;

a valve assembly attached to said canister, said valve assembly including a valve stem protruding from said pressurizable canister and having a passage therein no provide an outlet for flow of product from said canister;

an actuation mechanism mounted onto said pressurized canister for operation of said valve assembly, said actuation mechanism comprising:

an actuation plunger including a dispensing channel formed therein for communication with said passage in said valve assembly and an outwardly extending plunger tab formed thereon, said actuation plunger being mounted in slip fit engagement with said valve stem in an inoperative position spaced from a top surface of said valve stem and in an operative position in contact with a top surface of said valve stem; and a collar mounted to a top of said canister to contain said actuation plunger, said collar further comprising:

an upstanding wall having an opening therein for receiving said plunger tab during depression of said actuation plunger, and at least one inwardly directed locking tab extending from a topmost height of said wall and formed at a height above a top surface of said actuation plunger to extend over said actuation plunger, and a shoulder having an upward facing surface rotatably spaced from said locking tab and formed at a height to support said plunger tab in a position rotatably spaced from said opening in said upstanding wall to retain said plunger within said collar in spaced relation from the top surface of said valve stem.

25. The dispenser of claim 24, wherein said collar includes a further opening in said upstanding wall to expose said dispensing channel in said actuation plunger when said plunger is in a position depressible into the operative position.

26. The dispenser of claim 24, wherein said collar further comprises a locking detent protruding from said shoulder.

27. The dispenser of claim 24 wherein said actuation plunger further comprises a passage for receiving said valve stem, a portion of said passage having a tapered configuration to guide said valve stem.

28. The dispenser of claim 27, wherein said passage has a chamfered lower edge adjacent said valve stem.

29. The dispenser of claim 24, further comprising a biassing element disposed to bias said valve stem into a closed position.

* * * * *

UNITED STATES PATENT AND TRADEMARK OFFICE

CERTIFICATE OF CORRECTION

PATENT NO. : 5,388,730

DATED : February 14, 1995

INVENTOR(S) : JOE L. ABBOTT ET AL.

It is certified that error appears in the above-indentified patent and that said Letters Patent is hereby corrected as shown below:

Column 2, line 3, "± 0,002 inch" should read --± 0.002 inch--.

Column 10, line 32, "no provide" should read --to provide---.

Signed and Sealed this

Twelfth Day of March, 1996

*Attest:*

Bruce Lehman

BRUCE LEHMAN

*Attesting Officer*

*Commissioner of Patents and Trademarks*